US009230767B2

(12) United States Patent
Bunk et al.

(10) Patent No.: US 9,230,767 B2
(45) Date of Patent: Jan. 5, 2016

(54) BLOCKING ELEMENT FOR AN ELECTRICAL SWITCH

(71) Applicant: Siemens Aktiengesellschaft, Munich (DE)

(72) Inventors: Thomas Bunk, Sulzbach-Rosenberg (DE); Thomas Roman Abril, Amberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 8 days.

(21) Appl. No.: 14/226,995

(22) Filed: Mar. 27, 2014

(65) Prior Publication Data

US 2015/0001049 A1 Jan. 1, 2015

(30) Foreign Application Priority Data

Jul. 1, 2013 (DE) ..... 10 2013 212 798

(51) Int. Cl.
*H01H 9/28* (2006.01)
*H01H 71/10* (2006.01)

(52) U.S. Cl.
CPC ..... *H01H 71/1054* (2013.01); *H01H 9/285* (2013.01)

(58) Field of Classification Search
CPC ..... H01H 71/02; H01H 71/025; H01H 71/10; H01H 71/62; H01H 2003/00; H01H 9/22; H01H 27/06; H01H 9/28; H01H 89/08; H01H 15/00; H01H 3/00; H01H 3/02; H01H 3/001; H01H 3/20; H01H 3/3031; H01H 3/3042; H01H 3/32; H01H 3/38; H01H 3/54; H01H 9/0044; H01H 69/00; H01H 71/00; H01H 71/0264; H01H 71/0271; H01H 71/1072; H01H 71/128; H01H 71/50; H01H 71/52; H01H 71/521; H01H 71/522; H01H 71/523; H01H 71/524; H01H 73/06; H01H 73/24; H01H 73/38; H01H 73/50; H01H 73/60; H01H 2003/02
USPC ..... 200/43.16, 43.01, 43.08, 43.19, 332
See application file for complete search history.

(56) References Cited

U.S. PATENT DOCUMENTS

| | | | | |
|---|---|---|---|---|
| 2,288,270 | A | 6/1942 | Dorfman et al. | |
| 2,343,548 | A | 3/1944 | Graves, Jr. | |
| 4,392,036 | A * | 7/1983 | Troebel et al. | 200/322 |
| 2008/0277250 | A1 | 11/2008 | DeCook et al. | |

FOREIGN PATENT DOCUMENTS

| | | | |
|---|---|---|---|
| DE | 8509653 | U1 | 5/1985 |
| DE | 69200195 | T2 | 11/1994 |
| DE | 4322215 | C2 | 8/1995 |
| DE | 29706429 | U1 | 6/1997 |
| DE | 102010032035 | A1 | 1/2012 |

* cited by examiner

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

A blocking element is disclosed for blocking the movement of a handle or a switching lever of an electrical switch. In at least one embodiment, the blocking element is switchable between at least two positions. In the first position, the blocking element can block the movement of the handle or of the switching lever and, in the second position, the blocking element cannot block the movement of the handle or of the switching lever.

11 Claims, 6 Drawing Sheets

BLOCKING ELEMENT FOR AN ELECTRICAL SWITCH

PRIORITY STATEMENT

The present application hereby claims priority under 35 U.S.C. §119 to German patent application number DE 102013212798.7 filed Jul. 1, 2013, the entire contents of which are hereby incorporated herein by reference.

FIELD

At least one embodiment of the invention generally relates to an electrical switch, in particular a power circuit breaker.

BACKGROUND

Switching devices for switching electrical currents typically comprise at least one contact system and further housing modifications. The contact system forms an electrical switch and is used for switching electrical currents.

One class of switching devices are the so-called circuit breakers, which can typically switch currents of 100 A or more. These circuit breakers comprise a housing, in which the individual phases of the currents are switched. The individual phases of the currents can be accommodated in pole cartridges, which are enclosed by a dedicated housing.

A movable and a fixed contact are accommodated in the pole cartridges, the movable and fixed contacts being separable mechanically or brought together in order to switch off or on the currents. During separation of the movable and fixed contacts of a pole cartridge, an arc is produced which is typically quenched in a so-called quenching chamber. Likewise, circuit breakers are known which do not contain any pole cartridges and which accommodate movable and fixed contacts in their housing.

In the housings of the switching devices, in addition to the switching mechanism which can be actuated manually by way of a handle, for example, accessories can also be accommodated. Typically, the accessory is accommodated in a pocket in the housing of the electrical switch. The accessory is typically covered by an accessory cover, with the result that the accessory is protected from unauthorized access.

The accessory cover itself is often designed in such a way that, when the switch is switched on, the accessory cover cannot be removed from the housing of the electrical switch. For safety reasons, the electrical switch should be prevented from being switched on when the accessory cover is open.

SUMMARY

At least one embodiment of the invention resides in providing a corresponding mechanism which prevents the electrical switch from being capable of being switched on when the accessory cover is removed.

In at least one embodiment, the blocking element for blocking the movement of a handle or of a switching lever of an electrical switch is switchable between at least two positions. In the first position, the blocking element can block the movement of the handle or of the switching lever and, in the second position, the blocking element cannot block the movement of the handle or of the switching lever. It is advantageous here that the electrical switch cannot be switched on manually when the accessory cover is removed. This is important in order to protect an operator and to prevent faulty operation of the electrical switch.

The blocking element according to an embodiment of the invention can be part of an electrical switch, which comprises a handle and/or a switching lever for switching the electrical switch and a blocking element, wherein the blocking element is arranged in the electrical switch in such a way that, in the first position of the blocking element, the movement of the handle or of the switching lever of the electrical switch is blocked and, in the second position of the blocking element, the movement of the handle or of the switching lever is not blocked.

BRIEF DESCRIPTION OF THE DRAWINGS

Embodiments of the invention will be described below with reference to the following figures.

DETAILED DESCRIPTION OF THE EXAMPLE EMBODIMENTS

Figure 1:
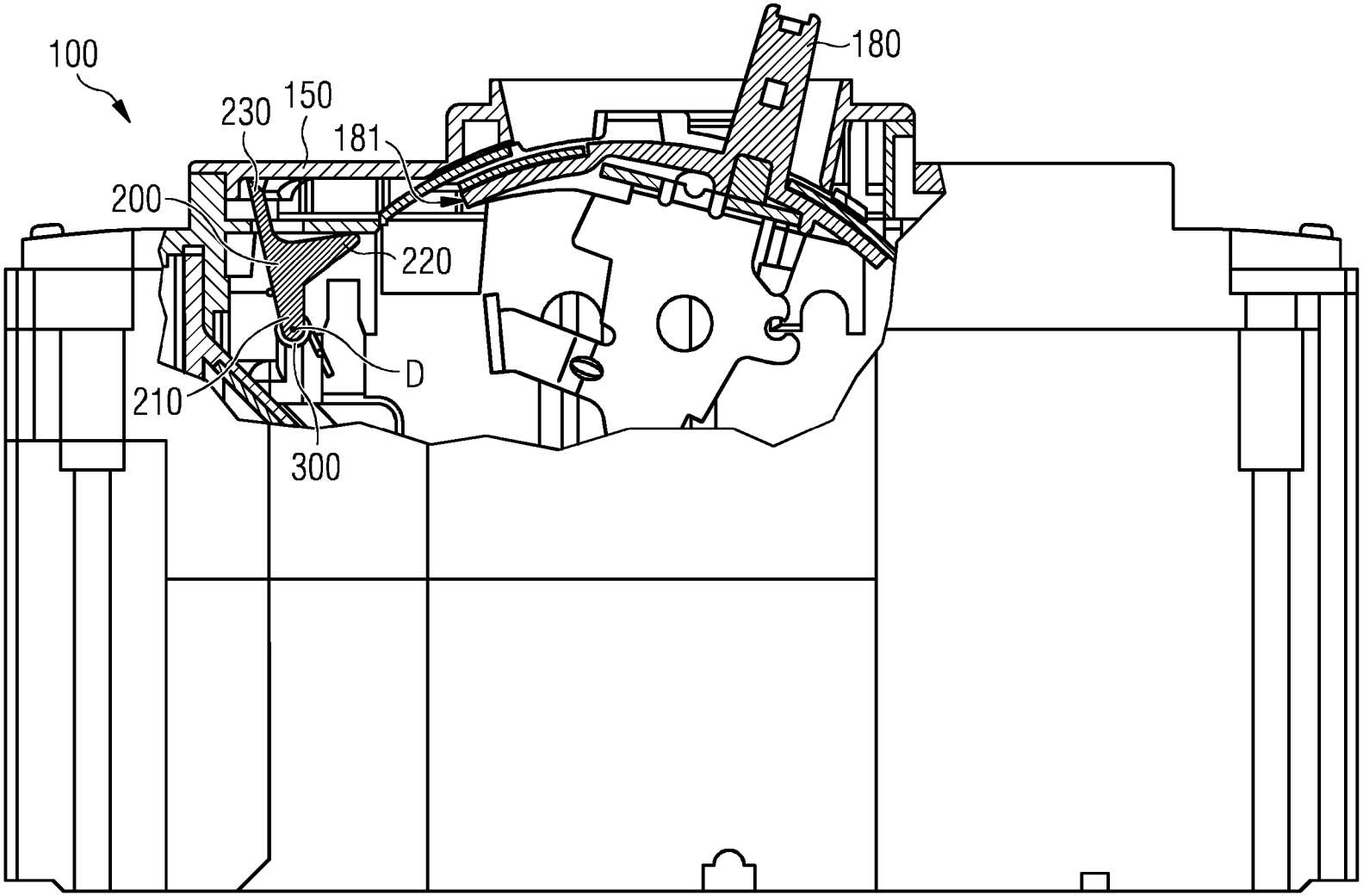
FIG. 1 shows an electrical switch comprising a blocking element and an accessory cover positioned thereon.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In at least one embodiment, the blocking element for blocking the movement of a handle or of a switching lever of an electrical switch is switchable between at least two positions. In the first position, the blocking element can block the movement of the handle or of the switching lever and, in the second position, the blocking element cannot block the movement of the handle or of the switching lever. It is advantageous here that the electrical switch cannot be switched on manually when the accessory cover is removed. This is important in order to protect an operator and to prevent faulty operation of the electrical switch.

In one configuration, the blocking element is a blocking rocker, which is mounted pivotably about an axis of rotation D. The blocking rocker can comprise a bearing point, and the bearing point can be formed as the axis of rotation D. The blocking rocker can comprise a first contour, which is designed to block the handle or the switching lever of an electrical switch. The blocking rocker can comprise a second contour, which is designed to interact with a component part of the electrical switch for pivoting the blocking rocker. The second contour can be designed to interact with a cover, in particular an accessory cover, an adapter plate or a drive, in particular a motor drive, a rotary drive or a door coupling drive, or another component part of the electrical switch.

In one configuration, the blocking rocker is substantially triangular, with the first corner as the bearing point, the second corner as the first contour, and the third corner as the second contour.

In a further configuration, the blocking element is designed to be in the second position when a component part of the electrical switch is positioned on the blocking element.

The blocking element additionally can comprise an elastic element, which is striving to transfer the blocking element to the first position. The elastic element can be in the form of a spring.

The blocking element according to an embodiment of the invention can be part of an electrical switch, which comprises a handle and/or a switching lever for switching the electrical switch and a blocking element, wherein the blocking element is arranged in the electrical switch in such a way that, in the first position of the blocking element, the movement of the handle or of the switching lever of the electrical switch is blocked and, in the second position of the blocking element, the movement of the handle or of the switching lever is not blocked.

The electrical switch can additionally comprise a component part, wherein when the component part is positioned, said component part switches the blocking element into the second position and, when the component part is removed, the blocking element is switched into the first position.

In a further configuration, the component part of the electrical switch can be a cover, in particular an accessory cover, an adapter plate or a drive, in particular a motor drive, a rotary drive or a door coupling drive.

FIG. 1 depicts an electrical switch 100 in a lateral sectional illustration. The electrical switch 100 comprises a handle 180, which is in the off position in the illustration in FIG. 1. The handle 180 is actuated along a circular path from an off position, which corresponds to the right-hand position in FIG. 1, into an on position, which would correspond to a left-hand position in FIG. 1. The handle 180 comprises a protrusion 181, which can interact with a blocking element 200.

In the example embodiment, the blocking element 200 is in the form of a blocking rocker. The blocking rocker 200 is configured such that it can block the movement of the handle 180 by virtue of its being pivotable into the movement of the handle 180. For this purpose, the blocking rocker 200 is mounted pivotably about an axis of rotation D with its bearing point 210. The blocking rocker 200 is pivotable between at least two positions. In its first position, it blocks the movement of the handle 180 and, in its second position, it cannot block the movement of the handle 180.

An accessory cover 150 is positioned onto the housing of the electrical switch 100. Said accessory cover closes the so-called accessory pockets, in which accessories can be installed in the electrical switch 100. The accessory cover 150 ensures that the blocking rocker 200 is moved into the second position, in which it cannot block the movement of the handle 180. This takes place by virtue of the fact that, for example, a second contour 230 of the blocking rocker 200 interacts with the accessory cover 150 of the electrical switch 100. By virtue of the fact that the blocking rocker 200 is held in the second position by the accessory cover 150, the protrusion 181 of the handle 180 can no longer be blocked by the blocking rocker 200. The electrical switch 100 can therefore be moved to and fro between its different positions without any limitation.

The blocking rocker 200 can be substantially triangular, with the first corner as the bearing point 210, the second corner as the first contour 220 and the third corner as the second contour 230.

The blocking rocker 200, in its first position, blocks the movement of the handle 180. This can be direct or likewise also indirect. Furthermore, the blocking rocker 200 can block the switching lever of an electrical switch 100.

Figure 2:
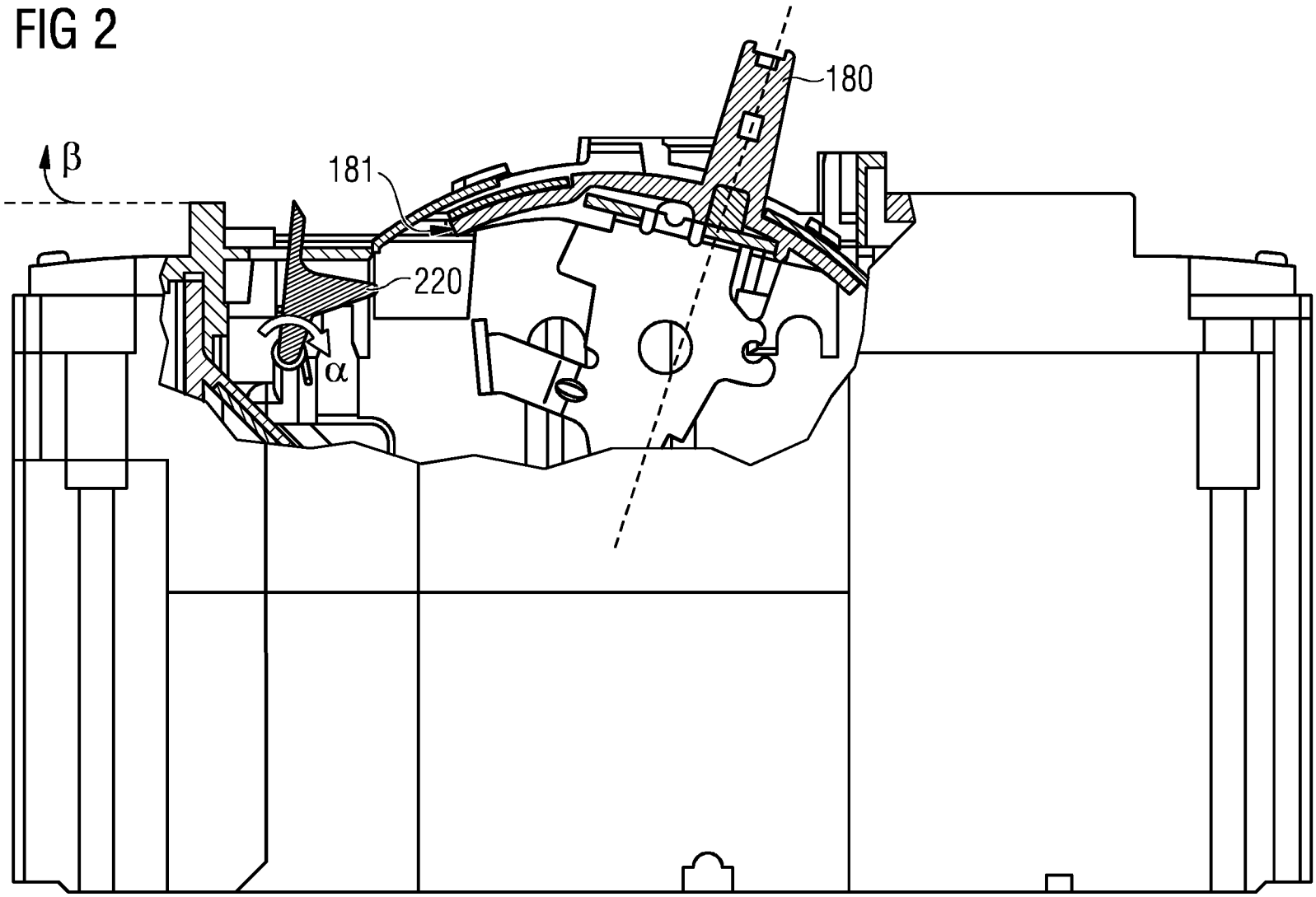
FIG. 2 shows an electrical switch comprising a blocking element with the accessory cover removed.

In the illustration corresponding to FIG. 2, in contrast to the illustration in FIG. 1, the accessory cover 150 is removed. The electrical switch 100 can contain a mechanism which prevents the accessory cover 150 from being removable in the on position of the electrical switch 100. This mechanism can therefore ensure that the accessory cover can only be removed in the case of a handle 180 in the off position of the electrical switch 100.

By virtue of the fact that, corresponding to the illustration in FIG. 2, the accessory cover 150 no longer interacts with the blocking rocker 200, the blocking rocker 200 pivots into the first position, in which it can block the movement of the handle 180. The second contour 230 of the blocking rocker 200 does not interact with the accessory cover 150. As a result, corresponding to the illustration in FIG. 2, the blocking rocker 200 tilts to the right about its axis of rotation D. The rotary angle of the blocking rocker 200 is denoted by $\alpha$, for example. By virtue of the fact that the blocking rocker 200 has rotated through the angle $\alpha$ in the clockwise direction, a first contour 220 of the blocking rocker 200 is now in the way of the movement of the handle 180. This is explained in more detail in FIG. 3.

Figure 3:
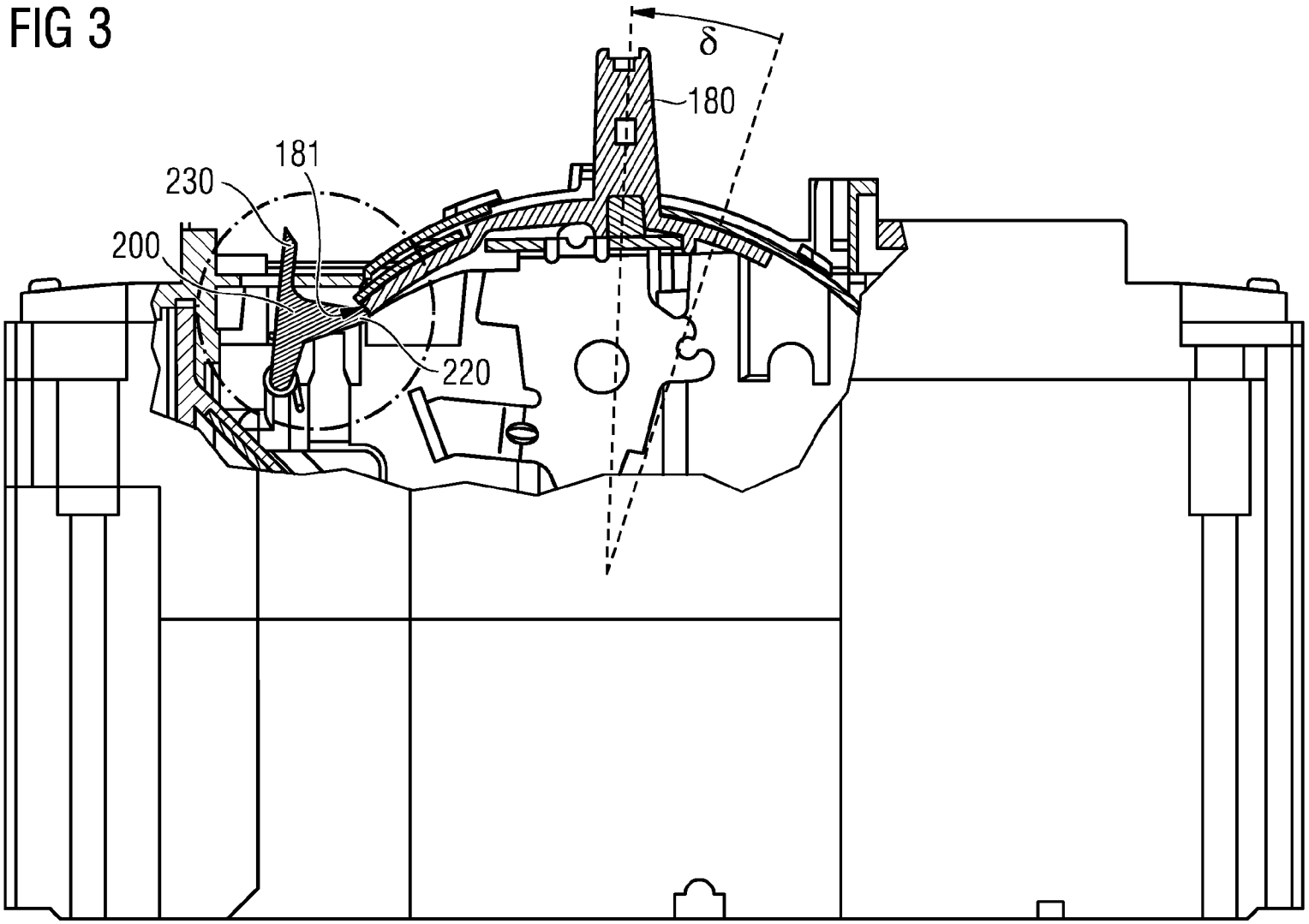
FIG. 3 shows an electrical switch comprising a blocking element, wherein the blocking element is in the first position.

FIG. 3 shows the electrical switch 100. In the figure, the handle 180 has been moved towards the left in the direction of the on position through an angle $\delta$. By virtue of the fact that the blocking rocker 200 has been transferred to the first position, the first contour 220 of the blocking rocker 200 now blocks the handle 180, with the result that it comes into mechanical contact with the protrusion 181. As a result, it is not possible for the handle 180 to be pivoted further to the left corresponding to the illustration in FIG. 3. It is therefore not possible for the handle 180 to cover a greater angle than the angle $\delta$, measured from the off position of the electrical switch 100. This blocking position is preferably provided before the tipping point in the direction of the on position of the handle 180.

Figure 4:
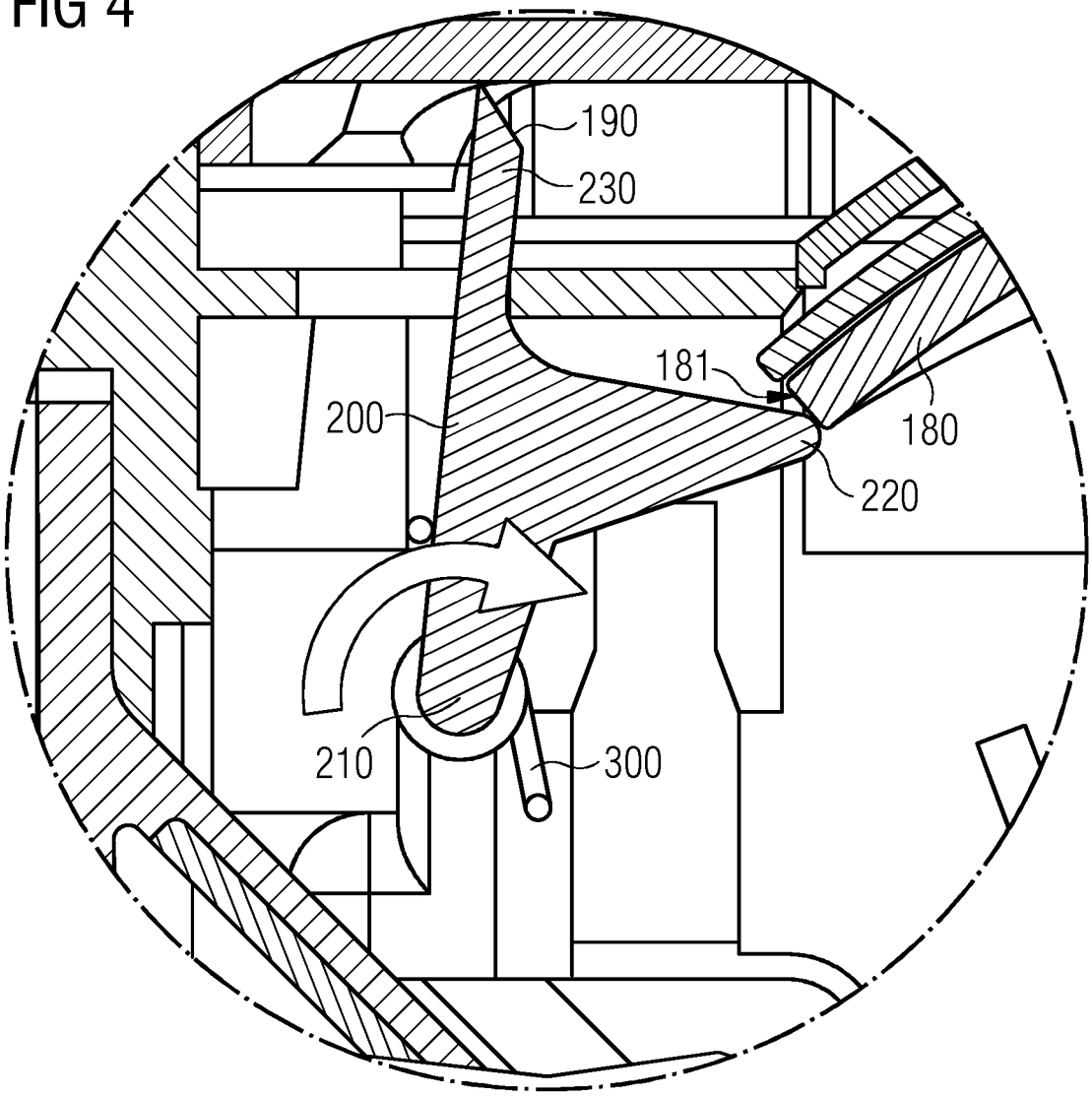
FIG. 4 shows a detail view of the blocking element, wherein the blocking element is located in the first position.

FIG. 4 shows an enlarged illustration of the blocking rocker 200 corresponding to the position of the electrical switch in FIG. 3. The blocking rocker 200 has been pivoted into the first position. As a result, the first contour 220 of the blocking rocker 200 blocks the path of the movement of the handle 180. The protrusion 181 of the handle 180 impinges on the first contour 220 of the blocking rocker, which prevents the handle from being capable of moving further in the direction of the on position of the electrical switch.

In order to transfer the blocking rocker 200 into the first position, said blocking rocker additionally comprises an elastic element 300, which can be in the form of a spring or correspondingly shaped plastic, for example. The spring 300 has the effect that the blocking rocker 200, when it is not interacting with the accessory cover 150, is transferred to the first position. Corresponding to the illustrations in FIGS. 1 to 4, this means that the spring 300 rotates the blocking rocker 200 in the clockwise direction. Provision can be made for the blocking rocker 200 to hit against a stop, for example against an edge 190 in the housing cover of the electrical switch 100, and therefore for the movement of the blocking rocker 200 in the clockwise direction to be limited.

As shown in FIG. 4, when attempting to move the handle 180 into the on position, a closing moment Mblock is introduced onto the blocking mechanism of the blocking rocker 200 by the blocking force Fblock. The blocking mechanism is therefore caused to self-inhibit, and the spring 300 is therefore assisted.

Figure 5:
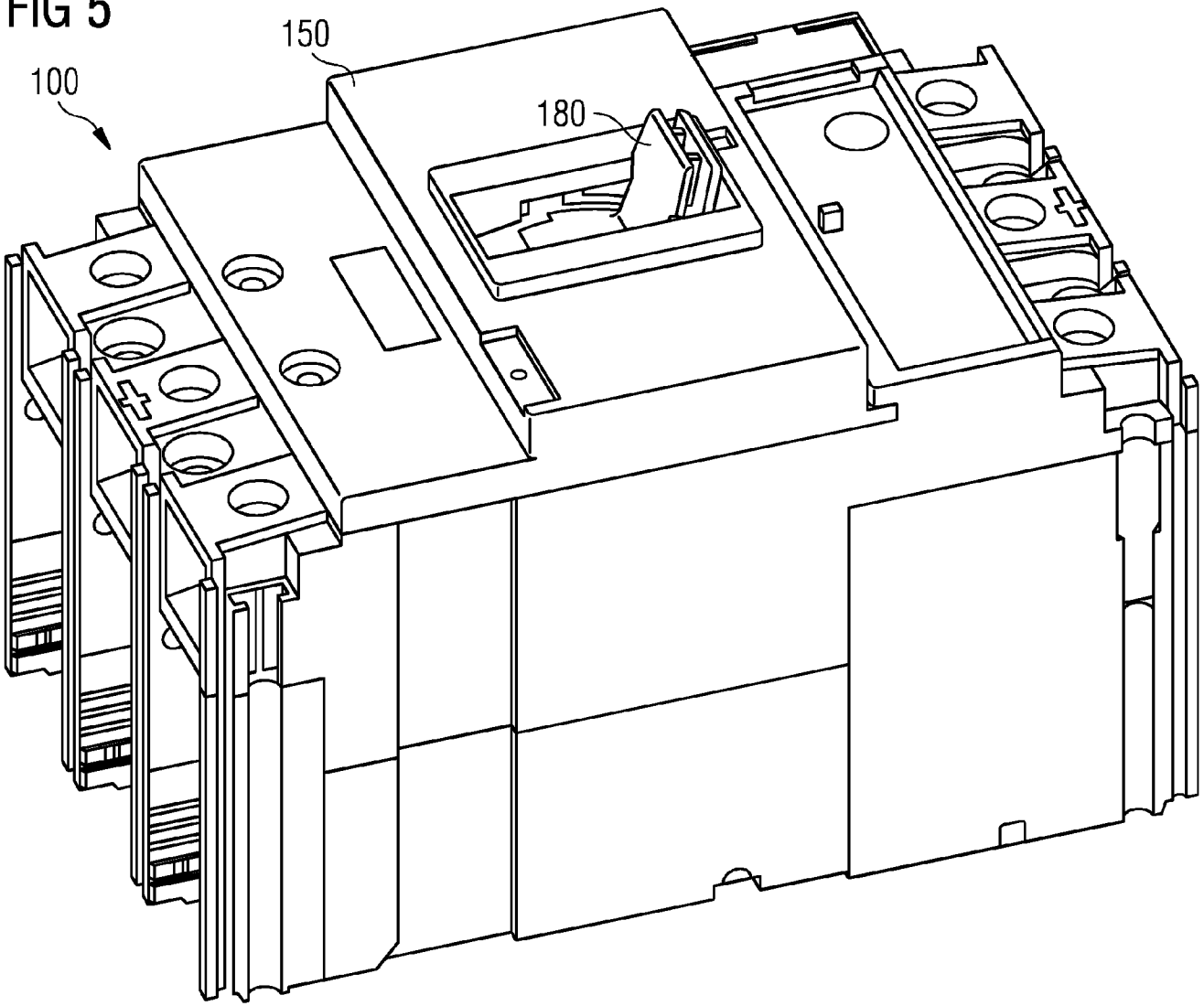
FIG. 5 shows a plan view of the electrical switch with the accessory cover positioned.

FIG. 5 illustrates the electrical switch 100 in a plan view of the electrical switch 100. The handle 180 passes through the accessory cover 150. The blocking rocker 200 is located within the housing of the electrical switch 100 and is not shown in the illustration in FIG. 5.

Figure 6:
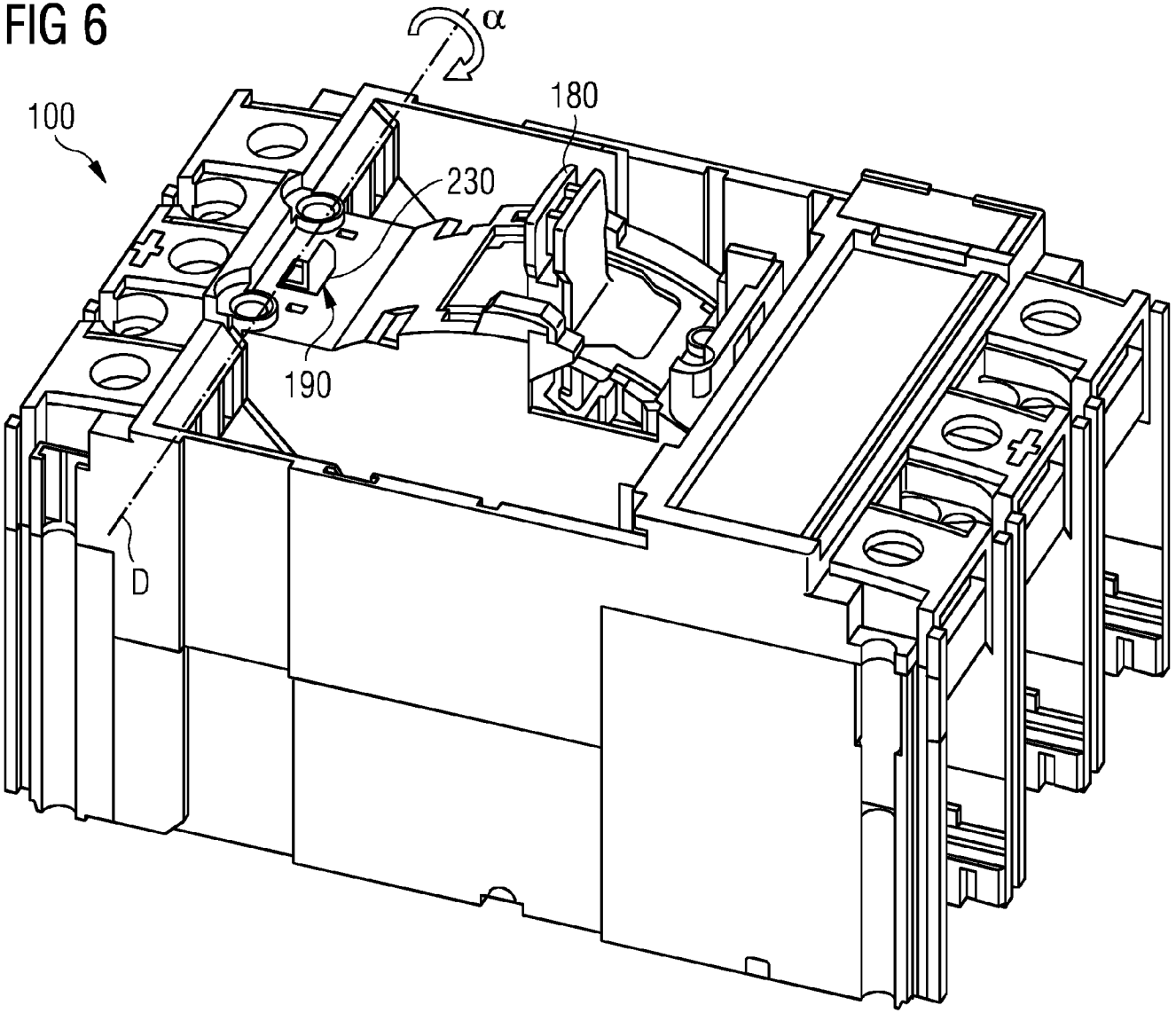
FIG. 6 shows a plan view of the electrical switch with the accessory cover removed.

FIG. 6 illustrates the electrical switch 100, again in a plan view, wherein the accessory cover 150 is removed. The electrical switch 100 comprises a handle 180, which is in a blocking position by virtue of the interaction with the blocking rocker 200. The blocking rocker 200 protrudes with its second contour 230 out of the housing of the electrical switch 100, with the result that this second contour 230 can interact with the accessory cover 150. The blocking rocker 200 is located in its first position, corresponding to FIG. 6, and therefore the second contour 230 is in its stop position. The blocking rocker 200 is pivoted about the axis of rotation D through the angle $\alpha$.

The second contour 230 can also interact with another component part 150 of the electrical switch 100 as the accessory cover, for example with a cover, an adaptor plate or a drive, in particular a motor drive, a rotary drive or a door coupling drive.

The kinematic and kinetic regulation of the blocking mechanism with the blocking element 200 is determined by the elastic element 300. As a result, the sensitivity with respect to the dynamics is controllable. The end of the rotary movement and therefore reaching of the blocking position of the blocking rocker 200 can be determined by a geometric configuration of the guide pocket. By virtue of the assisting force of the elastic element, the blocking element 200 is pressed against the edge 190 in the housing cover and held in its position. The limitation of the movement can, analogously to this, be released via another cross-arm or by another configuration feature.

Owing to the lack of touching contact between the blocking element 200 and the accessory cover 150, the blocking element 200 is caused to perform a rotary movement by the force of the elastic element 300 and moves into the blocking position, its first position, and held there. If the operator moves the handle 180 in the direction of the on position, this is blocked prior to the snapover point of the lock. In the process, the handle 180 impinges on the first contour 220 of the blocking rocker 200. The lock of the electrical switch 100 is prevented from snapping over and therefore prevents touching contact between the electrical contacts of the electrical switch 100.

A conceivable embodiment is to position the blocking element 200 in the housing of a switch. By virtue of the transmission ratio, only a relatively small rotary angle $\alpha$ is required for blocking the handle 180 and therefore the switching mechanism. By virtue of the favorable positioning of the axis of rotation D of the blocking rocker 200, in the event of the introduction of contact of the handle 180 on the first contour 220 of the blocking rocker 200, as a result of the contact force, a closing moment is introduced on the blocking rocker 200. Consequently, the mechanism is caused to self-inhibit and release of the blocking is avoided. The touching area of the housing of the electrical switch 100 at the upper end of the blocking element 200 and the early stop position in the housing upper part, for example, enable easy resetting of the mechanism. This is enabled by the large lever arms of the contact force with respect to the rotation point of the blocking element 200.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Although the invention has been illustrated and described in detail on the basis of the preferred example embodiment, the invention is not limited by the disclosed examples and other variations can be derived herefrom by the person skilled in the art, without departing from the scope of protection of the invention.

What is claimed is:

1. A blocking element for blocking the movement of a handle or a switching lever of an electrical switch, the blocking element being switchable between at least two positions and, in a first of the two positions, the blocking element is configured to block the movement of the handle or of the switching lever and, in a second of the two positions, the blocking element cannot block the movement of the handle or of the switching lever, the blocking element comprising:

a bearing point formed as an axis of rotation of the blocking element;

a first contour, designed to block the handle or the switching lever of an electrical switch;

a second contour, designed to interact with at least one of a cover and an adapter plate of the electrical switch for pivoting the blocking element, wherein removal of the at least one of the cover and an adapter plate causes rotation of the blocking element to block movement of the handle.

2. The blocking element of claim 1, wherein the blocking element is a blocking rocker, mounted pivotably about the axis of rotation.

3. The blocking element of claim 1, wherein the blocking rocker is substantially triangular, with a first corner as the bearing point, the second corner as the first contour, and the third corner as the second contour.

4. The blocking element of claim 1, wherein the blocking element is designed to be in the second position when a component part of the electrical switch is positioned on said blocking element.

5. The blocking element of claim 1, wherein the blocking element additionally comprises an elastic element, striving to transfer the blocking element to the first position.

6. The blocking element of claim 5, wherein the elastic element is in the form of a spring.

7. An electrical switch, comprising:

at least one of a handle and a switching lever, configured to switch the electrical switch;

a blocking element, the blocking element being arranged in the electrical switch such that, in a first position of the blocking element, movement of the at least one of the handle and the switching lever of the electrical switch is blocked and, in a second position of the blocking element, the movement of the at least one of the handle and the switching lever is not blocked; and a component part on an exterior surface of the electrical switch, wherein when the component part is positioned, said component part switches the blocking element into the second position and, when the component part is removed, the blocking element is switched into the first position.

8. The electrical switch of claim 7, wherein the component part of the electrical switch is a cover, an adapter plate or a drive.

9. An electrical switch, comprising:

at least one of a handle and a switching lever, configured to switch the electrical switch; and the blocking element of claim 2, wherein the blocking element is arranged in the electrical switch such that, in the first position of the blocking element, the movement of the at least one of the handle and the switching lever of the electrical switch is blocked and, in the second position of the blocking element, the movement of the at least one of the handle and the switching lever is not blocked.

10. The electrical switch of claim 9, further comprising:

a component part of the electrical switch, wherein when the component part is positioned, said component part switches the blocking element into the second position and, when the component part is removed, the blocking element is switched into the first position.

11. The electrical switch of claim 8, wherein at least one of the cover is an accessory cover, and the drive is a motor, rotary or door coupling drive.

* * * * *